United States Patent [19]

Sanderson, III

[11] Patent Number: 4,489,294

[45] Date of Patent: Dec. 18, 1984

[54] STARTER SOLENOID TERMINAL COVER

[75] Inventor: Robert W. Sanderson, III, Lombard, Ill.

[73] Assignee: International Harvester Company, Chicago, Ill.

[21] Appl. No.: 406,662

[22] Filed: Aug. 9, 1982

[51] Int. Cl.[3] ..... H01F 7/00

[52] U.S. Cl. ..... 335/209; 335/301

[58] Field of Search ..... 335/209, 202, 278, 301

[56] References Cited

U.S. PATENT DOCUMENTS 4,382,242 5/1983 Colvin et al. ..... 335/202

FOREIGN PATENT DOCUMENTS 1183578 3/1970 United Kingdom ..... 335/202

1253822 11/1971 United Kingdom ..... 335/278

*Primary Examiner*—George Harris

*Attorney, Agent, or Firm*—Dennis K. Sullivan; F. David AuBuchon

[57] ABSTRACT

End cover protecting a vehicle solenoid so that the usual molded plastic case thereof will not be cracked from contact of a falling object and so that electrical contact if made to any of the customary solenoid terminals at the end of its plastic case will be restricted to only the single terminal exposed by the cover.

7 Claims, 4 Drawing Figures

STARTER SOLENOID TERMINAL COVER

The exposed end of a vehicle starter solenoid is subject to unwanted contact from the impact of dropped tools and to unwanted electrical contact.

The end cover provided according to my invention protects the solenoid so that the usual molded plastic case thereof will not be cracked from direct contact of a tool falling upon the end of the solenoid case and so that electrical contact if made to any of the customary solenoid terminals protruding from the end of the case will be restricted to only the single terminal exposed by the cover. The encroaching object is countered by the cover deflecting and tending to veer if off.

Figure 1:
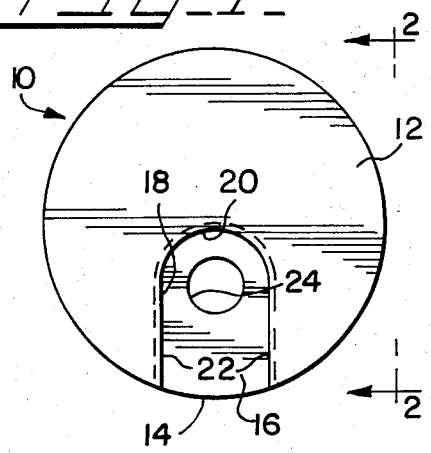
Figure 2:
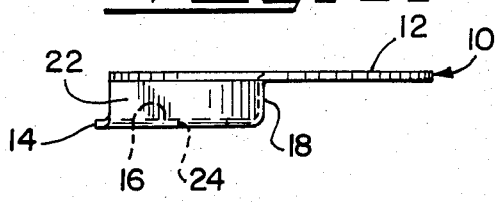
Figure 4:
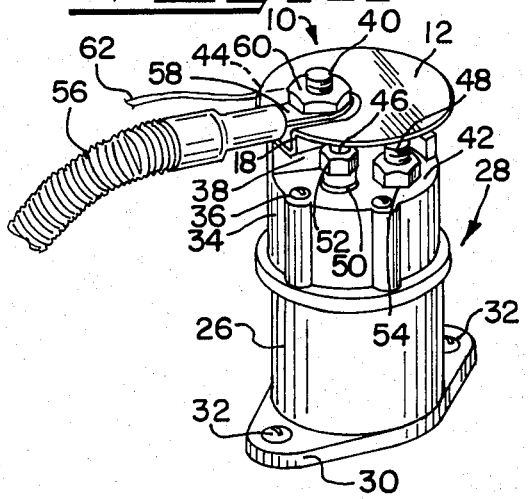
Figure 3:
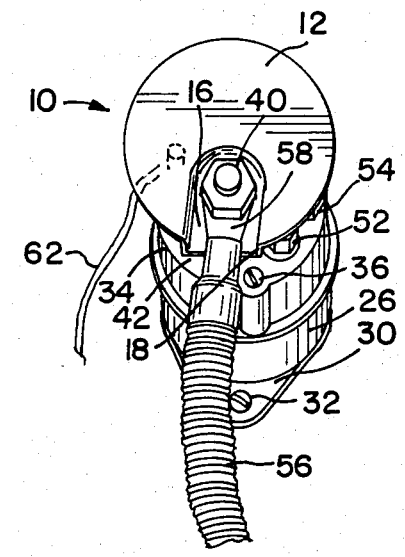

The solenoid end cover employed in the practice of my invention is thin, light, inexpensive, easy to install right where it forms an effective guard, and requires no tools or attachment clips, all as will now be explained and amplified upon by illustration. Various features, objects and advantages will either be specifically pointed out or become apparent when, for a better understanding of the invention, reference is made to the following description taken in conjunction with the accompanying drawing which shows a preferred embodiment thereof and in which:

FIGS. 1 and 2 are top plan and left side elevational views of a cover embodying my invention; and FIGS. 3 and 4 show, in respective perspective views taken at different angles, the cover and a vehicle starter solenoid on which the cover is shown installed.

More particularly, a two-level cover 10 of thin, electrically insulative plastic is shown in FIGS. 1 and 2 having a precisely circular shape in plan view despite its stepped construction. A flat face portion 12 thereof serves as a deflector area and a depressed portion 14 has a flat floor 16 serving as an attachment area.

A U-shaped wall or web 18 consisting of a semicylindrical section 20 and a pair of parallel straight legs 22 integrally joins together the flat attachment floor 16 of the depressed portion and the flat face portion 12 which can be seen to have the outer edges of a companion U-shaped slot in the latter extending from the center to the outer edge of the flat face portion.

A terminal stud opening 24 is offcenter to the circular shape described but concentric with the semicylindrical section 20 of the web 18.

In FIGS. 3 and 4, the cylindrical inner end body piece 26 of a regular two-part case for a starter solenoid 28 has a base attachment flange 30 secured by cranking motor hold down screws 32 to the case of a tractor cranking motor, not shown. The essentially cylindrical exposed end or thick nose piece 34 of the solenoid case is secured by screws 36 to the body piece 26 of the case and is consistent in shape with the generally circular cross section of the case of the solenoid 28 with respect to its longitudinal central axis.

From the top, not shown, of the main terminal base 38 a threaded main battery terminal stud 40 protrudes longitudinally the rigid same as the upraised base 38 from the plastic transverse end face 42 of the solenoid case. Secondary threaded terminal studs, unshown but occupying the vicinity 44, and also explicitly shown at 46 and 48 protrude from similar terminal bases such as at 50 incorporated in the plastic end face 42.

The latter terminal studs carry individual nuts 52 and 54 for external electrical wire connections. Internal connections within solenoid 28 are such that electrical contact made with stud 46 whether intended or inadvertent causes the solenoid 28 to activate the cranking motor.

The main terminal 40 projects at the end beyond the end of all secondary studs by an appreciable amount and the terminal 40 is much the larger in cross section to carry full motor current.

INSTALLATION—FIGS. 3,4

The starter solenoid 28 receives the cover 10 in transverse, substantially coaxial relation thereto in respect of the solenoid cylindrical cross section, with the main terminal stud 40 receiving the opening 24, not shown, so that the cover attachment floor 16 rests squarely on the main terminal base 38, or on a standard intervening nut, as appropriate.

The plastic end face 42 and the guard's flat face portion 12 maintain planes parallel to one another. The floor 16 holds the latter face portion 12 just offset past the relatively foreshortened secondary stud ends; whereas the main cable stud 40 projects at the end perceptibly beyond the face portion 12, leaving only the exposed and unguarded main metal terminal accessible.

A battery cable 56 for powering the cranking motor has an apertured end lug or terminal 58 coaxially received on the solenoid terminal 40 with the cable lug or terminal 58 extending out the slot-like depressed portion 14 (FIG. 1) parallel to and between the respective planes of the floor 16 and flat face portion 12 of the cover. The solenoid is electromagnetically de-energized and energized and closes and opens the main contacts, not shown, interconnecting the battery and the cranking motor.

A main retaining nut 60 threaded onto the terminal 40 clamps down on the cable lug or terminal 58 in a coaxial relation to the terminal stud opening 24, not shown, and to the terminal 40 itself within the opening. The vehicle battery thus maintains the terminal 40 at battery voltage B+ at all times. No special fastener or tool is required; retention of both the battery lug and cover, afforded when the common retaining nut is tightened down, gives to the latter a dual function, with the cover extending in its plane away from the main terminal in one direction and the lug extending in the radially opposite direction.

An ignition key-switch-connected lead wire 62 is secured to another of the secondary terminals located in the vicinity 44 of FIG. 4. Several of the secondary terminals are effective to actuate the solenoid when energized at B+ voltage, including the terminal to which the ignition key switch lead wire 62 is connected. Obviously the starter motor is intended to crank the vehicle engine when the ignition key on the instrument panel, not shown, is switched to the standard start position provided.

In one physically constructed embodiment of the invention the exposed cylindrical end piece 34 of the case was made of the standard electrically insulative material, Bakelite plastic. The cover 10 was a molded, integrally colored black part suitable as to weather for normal use as an interior part and made of a polyester thermoplastic material such as butylene terephthalate, which is satisfactory; its desired qualities are flexibility, impact resistance, weather resistance, resilience, and an electrically insulative character.

The body 26 of the solenoid is a ferromagnetic basic metal or alloy customary in the industry.

From FIG. 3, it is apparent by mere inspection that a jumper cable end clamp leading by cable from the battery of another vehicle encounters the cover 10, as viewed face-on, so that it cannot apply B+ voltage to the ignition switch lead wire terminal or the other secondary terminals 46 and 48; nor is there any way for the end clamp or a tool to strike and to short the battery terminal 40 to those secondary terminals so as unwantedly to cause the tractor starter to begin cranking. Similarly, the nose piece plastic is guarded by the plastic thereover from being directly struck by a tool, affording the other of the sought for safeguards to electrically and mechanically protect the solenoid against the undesired activated state or a cracked case.

The readily displaceable thin cover 10 (1.5 mm thick, for example) after being struck immediately springs back to its undeflected, planar guard position. The lug 58 and tightened retaining nut 60 frictionally hold the cover 10 from pivoting in plane out of place. In regard to bending when displaced by being struck, the plastic disk conforms to the oncoming blow by assuming from outside edge inward a deflecting angle to ward off the object from a direct line of impact upon the rigid plastic nose piece 34 of the solenoid case. In other words, the inherent give by tilting has a veering-off action tending to transform the striking motion into a glancing blow.

Variations within the spirit and scope of the invention described are equally comprehended by the foregoing description.

What is claimed is:

1. Insulating end cover for the terminaled end of starter solenoids and like devices, said cover being formed of a thin flexible sheet of readily bendable and deflectable insulation having a major face portion of the cover adapted to overlie the terminaled end of the device, a depressed portion in the periphery of the face portion having a main terminal opening in the floor of the depressed portion, and a wall of generally U-shape providing offset of the face portion from the floor and integrally joining together the face and depressed portions.

2. The invention according to claim 1, in combination with a device which is such as the one described and which is essentially circular in cross section at said end, said cover therefor being an essentially circular disk.

3. The invention according to claim 2, wherein the face portion which is planar, and the floor of the depressed portion which is planar, occupy spaced apart parallel planes.

4. The invention according to claim 3, for use with an apertured cable terminal from a battery, said depressed portion of the circular disk adapted to receive the cable terminal so that the latter is in the space between the planes of the face portion and floor and parallel thereto.

5. Covered solenoid device having a terminaled end portion including one large terminal stud projecting beyond a stud end base thereon, and at least a second terminal stud with a similar stud end base thereon and projecting less far out with respect to the terminaled end portion and the projecting large terminal stud;

an end cover for said terminaled end portion and second stud of the solenoid device, said cover formed of a thin flexible sheet of readily bendable and deflectable insulation, and presenting an outer insulator face transverse to and offset from said end portion and, as viewed from face-on, having a slot-like depression defining an attachment floor to the device extending inwardly on the cover from an edge toward the center, and a main terminal opening in said attachment floor overlying the large stud end base and receiving the large stud therethrough; and an apertured battery cable terminal arranged with its aperture likewise receiving the large stud therethrough and with the cable terminal itself secured within the slot-like depression and projecting outwardly in the plane of that slot.

6. The invention according to claim 5, characterized by:

said device and its end portion being essentially circular in cross section with respect to its central axis;

said end cover thereon being essentially circular as viewed from face-on and substantially concentric to said device's central axis; and said slot and the cable terminal therein disposed essentially radially with respect to the central axis aforesaid.

7. Starter solenoid equipped with a terminaled thickened nose piece of rigid insulative plastic and with an end guard thereover for protection comprising, in combination therewith, a threaded battery cable terminal with its base fixed in the nose piece and projecting at the end therefrom, and a flexible disk formed of a thin bendable and deflectable insulator sheet of plastic and having a retaining nut and having an attachment portion both secured on and by the cable terminal to the plastic nose piece, whereby the plastic disk constitutes said end guard protecting by flexible plastic over thickened rigid plastic.

* * * * *